US008341891B1

(12) United States Patent
Pavlansky et al.

(10) Patent No.: US 8,341,891 B1
(45) Date of Patent: Jan. 1, 2013

(54) STACKABLE RAIN GUTTER FILTER ADAPTED FOR TOOLESS INSTALLATION

(76) Inventors: Mark Pavlansky, Elkin, NC (US); Keith Pavlansky, Yadkinville, NC (US); Stephen Larson Harper, Winston-Salem, NC (US)

( * ) Notice: Subject to any disclaimer, the term of this patent is extended or adjusted under 35 U.S.C. 154(b) by 344 days.

(21) Appl. No.: 12/658,106

(22) Filed: Feb. 2, 2010

(51) Int. Cl.
*E04D 13/00* (2006.01)

(52) U.S. Cl. ..... 52/12; 52/13; 210/162; 210/170.03; 210/483

(58) Field of Classification Search ..... 52/12–15; 210/162, 170.03, 483, 510.1; 248/48.1, 48.2
See application file for complete search history.

(56) References Cited

U.S. PATENT DOCUMENTS

| | | | | | |
|---|---|---|---|---|---|
| 546,042 | A * | 9/1895 | Van Horn | 52/12 |
| 2,271,081 | A * | 1/1942 | Layton | 52/12 |
| 3,864,267 | A * | 2/1975 | Nelems | 210/474 |
| 4,032,456 | A * | 6/1977 | Berce | 210/474 |
| 4,435,925 | A * | 3/1984 | Jefferys | 52/12 |
| 4,590,716 | A * | 5/1986 | Smith | 52/12 |
| 4,607,465 | A * | 8/1986 | Hopkins | 52/12 |
| 4,841,686 | A * | 6/1989 | Rees | 52/12 |
| 4,866,890 | A * | 9/1989 | Otto | 52/12 |
| 4,888,920 | A * | 12/1989 | Marulic | 52/12 |
| 4,905,427 | A * | 3/1990 | McPhalen | 52/12 |
| 4,945,690 | A * | 8/1990 | Otto | 52/12 |
| 4,949,514 | A * | 8/1990 | Weller | 52/12 |
| 5,251,410 | A * | 10/1993 | Carey | 52/12 |
| 5,522,183 | A * | 6/1996 | Allen | 52/12 |
| 5,595,027 | A * | 1/1997 | Vail | 52/12 |
| 5,640,810 | A * | 6/1997 | Pietersen | 52/12 |
| 5,729,931 | A * | 3/1998 | Wade | 52/12 |
| 5,755,061 | A * | 5/1998 | Chen | 52/12 |
| 5,916,092 | A * | 6/1999 | Chen | 52/12 |
| D417,264 | S * | 11/1999 | Beth | D23/261 |
| 6,067,755 | A * | 5/2000 | Maanum | 52/12 |
| 6,134,843 | A * | 10/2000 | Tregear | 52/12 |
| 6,463,700 | B2 * | 10/2002 | Davis | 52/12 |
| 6,493,994 | B1 * | 12/2002 | Lucas | 52/12 |
| 6,598,352 | B2 * | 7/2003 | Higginbotham | 52/12 |
| 7,208,081 | B2 * | 4/2007 | Jones | 210/162 |
| 7,310,912 | B2 * | 12/2007 | Lenney et al. | 52/12 |
| D615,632 | S * | 5/2010 | Wootton | D23/267 |
| 8,042,304 | B2 * | 10/2011 | Contreras | 52/12 |
| 8,069,617 | B2 * | 12/2011 | Wootton | 52/12 |
| 2001/0037610 | A1 * | 11/2001 | Davis | 52/12 |

(Continued)

FOREIGN PATENT DOCUMENTS

FR 2640661 A1 * 6/1990

*Primary Examiner* — Robert Canfield
*Assistant Examiner* — Charissa Ahmad
(74) *Attorney, Agent, or Firm* — Robert W. Pitts

(57) ABSTRACT

A filter for use with a rain gutter will prevent solid debris, such as leaves, from entering the gutter, but will not unduly restrict passage of rain water into and through the gutter. The filter comprises a liquid permeable strip that can be formed of a material, such as reticulated polyurethane foam. This strip is supported at the top of the gutter by a support member, which can be a thermoformed member, affixed to the underside of the strip. Legs, which can fold transversely to the strip will support the strip above the bottom of the gutter. When the legs are in a flat configuration, multiple filter members can be stacked for storage and shipping. Installation is essentially toolless and the filters can be cut to length.

10 Claims, 9 Drawing Sheets

U.S. PATENT DOCUMENTS

2003/0159365 A1* 8/2003 Hutton ..... 52/13
2005/0247611 A1* 11/2005 Groth et al. ..... 210/162
2006/0037253 A1* 2/2006 Mozeika, III ..... 52/12
2009/0090067 A1* 4/2009 Demartini ..... 52/12
2009/0178366 A1* 7/2009 Konkey ..... 52/745.2
2009/0288349 A1* 11/2009 Wootton ..... 52/12

* cited by examiner

STACKABLE RAIN GUTTER FILTER ADAPTED FOR TOOLESS INSTALLATION

BACKGROUND OF THE INVENTION

1. Field of the Invention

This invention is related to the use of a porous filter that is supported at the top of a rain gutter to prevent entry of solid debris into the rain gutter while allowing rain water to flow thought the porous filter into the relatively unobstructed gutter. More specifically this invention is directed to the use of porous foam or a reticulated foam for the filter and the use of a support member to position the foam filter on top of the gutter leaving the rain gutter largely unobstructed.

2. Description of the Prior Art

There are a number of devices that are employed to prevent solid debris, such as leaves, pine needles, twigs and litter from entering a rain gutter and clogging the gutter. There are a number of shields or filters that are employed to prevent entry of solid debris, but allow water to pass over the filter or shield and enter the gutter. Alternatively some prior art techniques employ a porous filler or filter material that can be inserted into and at least partially fill the gutter. The porous filler material will be liquid permeable so that rain water can flow through the material and in the rain gutter. The pores or openings in such materials are, however, sufficient small to prevent the entry of solid debris that is not dissolved in the rain water or in liquid flowing into the gutter. The solid debris will then accumulate on top of the filler material where it will normally be removed by the wind or by gravity.

U.S. Pat. No. 3,855,132 discloses the use of a porous polyurethane foam to fill a rain gutter. Rain water will flow through a sufficiently porous foam filling the rain gutter, but debris, such as leaves and paper scraps remain on the upper surface of the foam filler and cannot enter the rain gutter where clogs typically form. Supports can be provided along the length of the foam filler to leave an open passageway beneath the foam filler and above the bottom of the rain gutter.

US Patent Application Publication 2005/0034376 discloses the use of a porous sponge-like filler materials, such as fibers or foam or non-woven materials that can be cut to shape and packed into the gutter.

US Patent Application Publication 2005/0247611 discloses the use of a thick mat formed from a nonwoven material including randomly oriented and interconnected fibers or filaments forming open interstices affixed by a binder or coating. This mat is inserted into a rain gutter and in some cases in conjunction with a filter will prevent twigs, pine needles etc. from entering the rain gutter. Openings may be formed between the porous mat and bottom or side surfaces of the gutter to permit flow beneath the mat insert. U.S. Pat. No. 7,208,081 shows a similar gutter filler in which the foam filter material partially fills the gutter.

Even thought these gutter filler products are porous, they still can restrict the flow in a gutter, and because they must fill a substantial volume of the gutter, they can be relatively bulky and will use a significant amount of a material. It may also be difficult to install these products on rain gutters because roofing shingles may partially obstruct the rain gutters and gutter hangers can present obstructions.

SUMMARY OF THE INVENTION

A filter according to this invention can be mounted, without the use of tools on a rain gutter to prevent solid debris from clogging the gutter. Such a filter can include a liquid permeable strip configured to extend along a rain gutter. The liquid permeable strip is formed of material sufficiently closely spaced to prevent passage of solid debris therethrough and into the rain gutter. A support member is attached to an underside of the liquid permeable strip and configured to support the liquid permeable strip above a bottom surface of the rain gutter and along an open upper top of the rain gutter. The support member has a base attachable the liquid permeable strip and at least one leg hinged relative to the base, so that the base and the leg extend generally parallel to the liquid permeable strip in a generally flat storage and shipping position. At least one leg can be hinged into a position transverse to the base to support the liquid permeable strip in the rain gutter.

A device according to this invention will prevent clogging of a rain gutter by leaves, twigs and solid debris. This device can include a liquid permeable foam strip having a width sufficiently to span a rain gutter and having a length greater than the width, and a thickness sufficient to prevent passage of leaves, twigs and solid debris therethrough. The device also includes a support member having a thickness less than the thickness of the porous foam strip. This support member will support the liquid permeable foam strip above a bottom surface of the rain gutter and can have a series of spaced apart arms affixed to an undersurface of the support member leaving a portion of the undersurface of the liquid permeable foam strip exposed to allow rain to pass through the liquid permeable foam strip and into the rain gutter. Legs extending from the spaced apart arms can extend transverse to the spaced apart arms and to the liquid permeable foam strip to support the liquid permeable foam strip above the bottom surface of the rain gutter.

A preferred embodiment of this invention employs a thermoformed support member affixed to the liquid permeable foam member. The thermoformed support member is formed of formable material and includes a protruding rib extending between opposite ends of the thermoformed support member. A series of spaced apart arms extend from one side of the protruding rib. The arms include a protruding ridge. The protruding ridges on the arms and the protruding rib are affixed to an undersurface of a liquid permeable foam member with gaps between spaced apart arms permitting flow of rain water through the liquid permeable foam member and into the gutter. A series of spaced apart legs extend from a second side of the protruding rib, transverse to the liquid permeable foam member to extend between the liquid permeable foam member and a bottom surface of a rain gutter in which the device is positioned.

BRIEF DESCRIPTION OF. THE DRAWINGS

DETAILED DESCRIPTION OF THE PREFERRED EMBODIMENT

Figure 1:
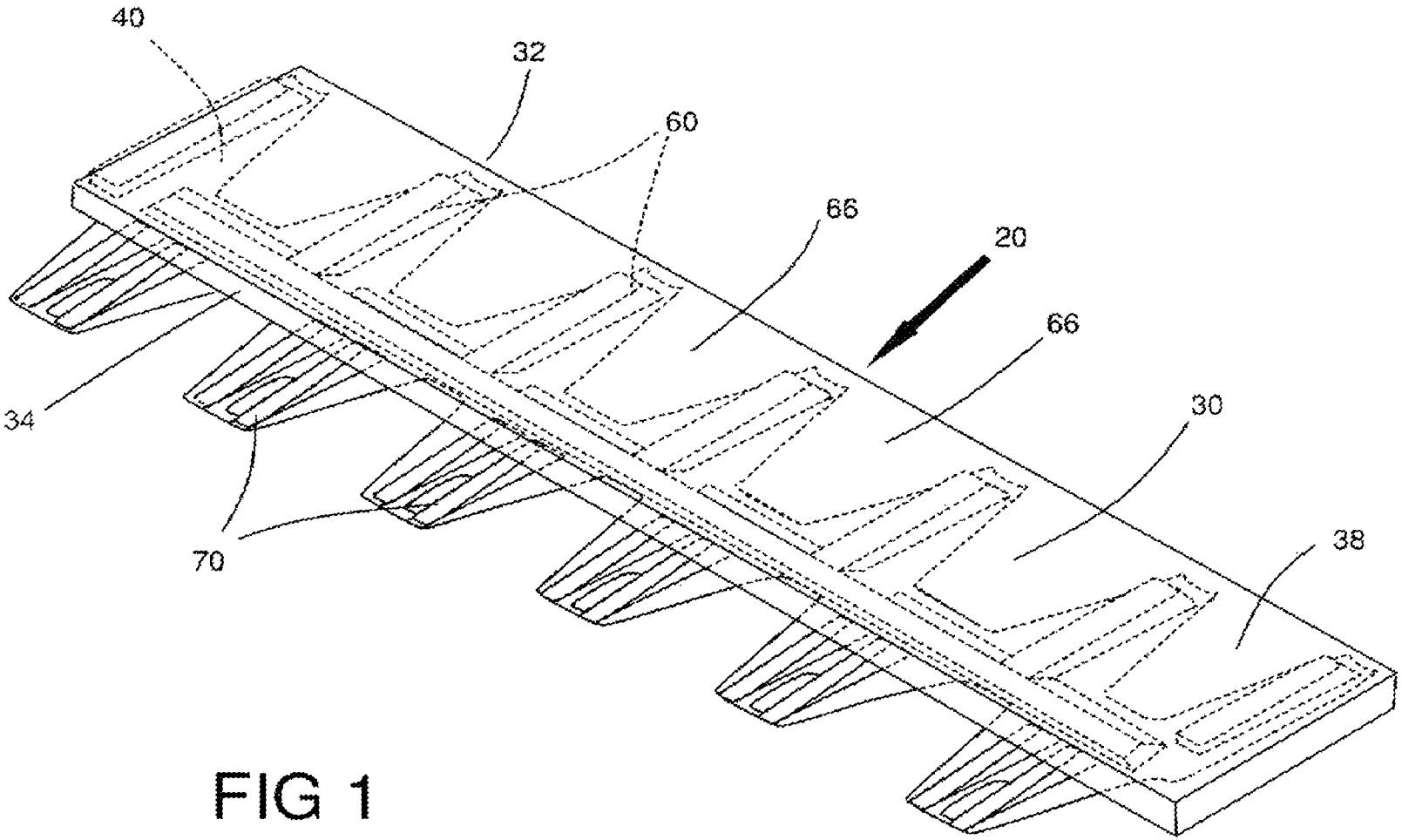
FIG. 1 is a three dimensional view of a rain gutter filter according to this invention, which includes a liquid permeable or porous strip affixed to a support member, shown here in a flat storage or shipping position in which multiple filters can be stacked on top of each other.
Figure 2:
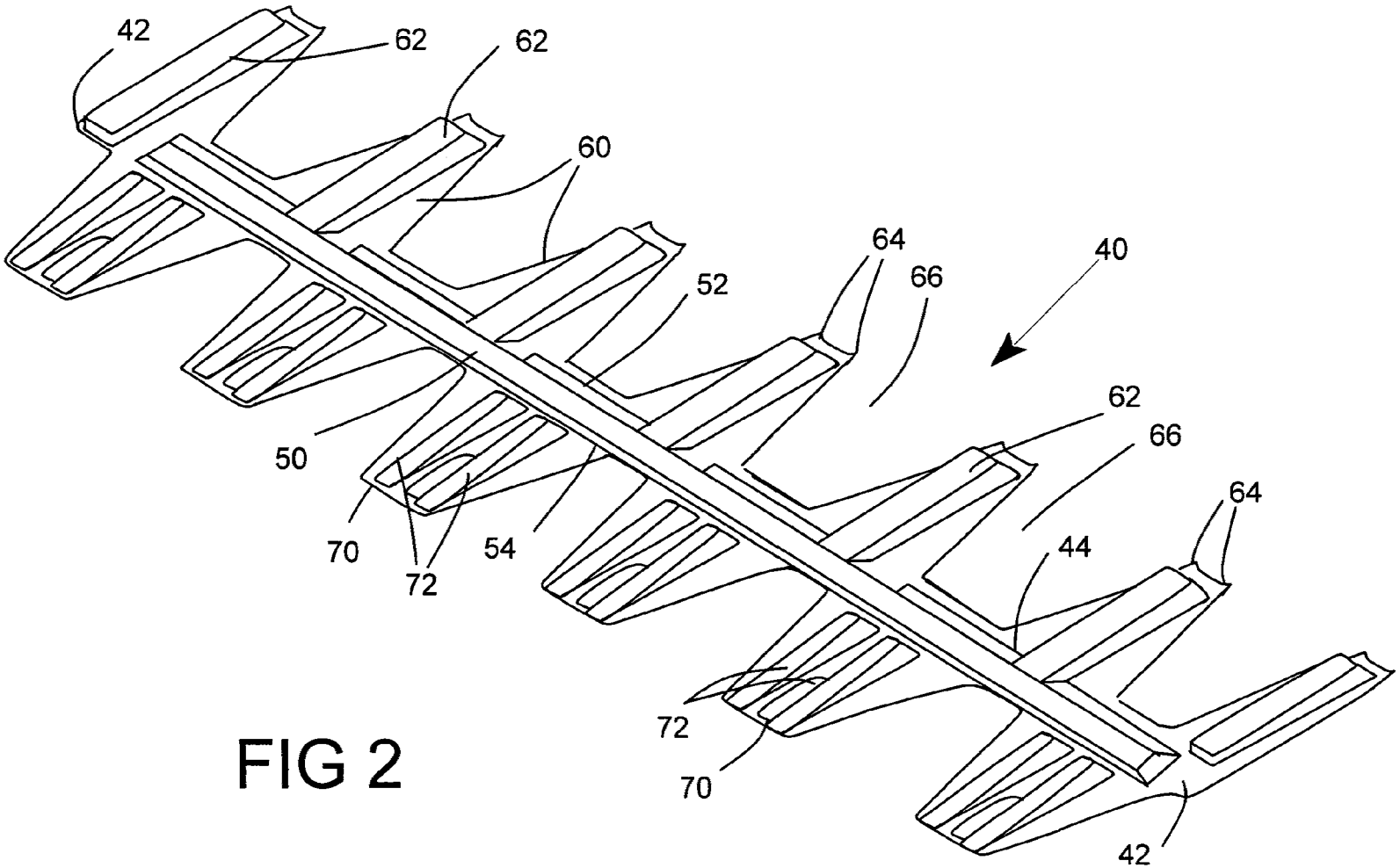
FIG. 2 is a three dimensional view of the support member which forms a part of the rain gutter filter shown in FIG. 1.
Figure 3:
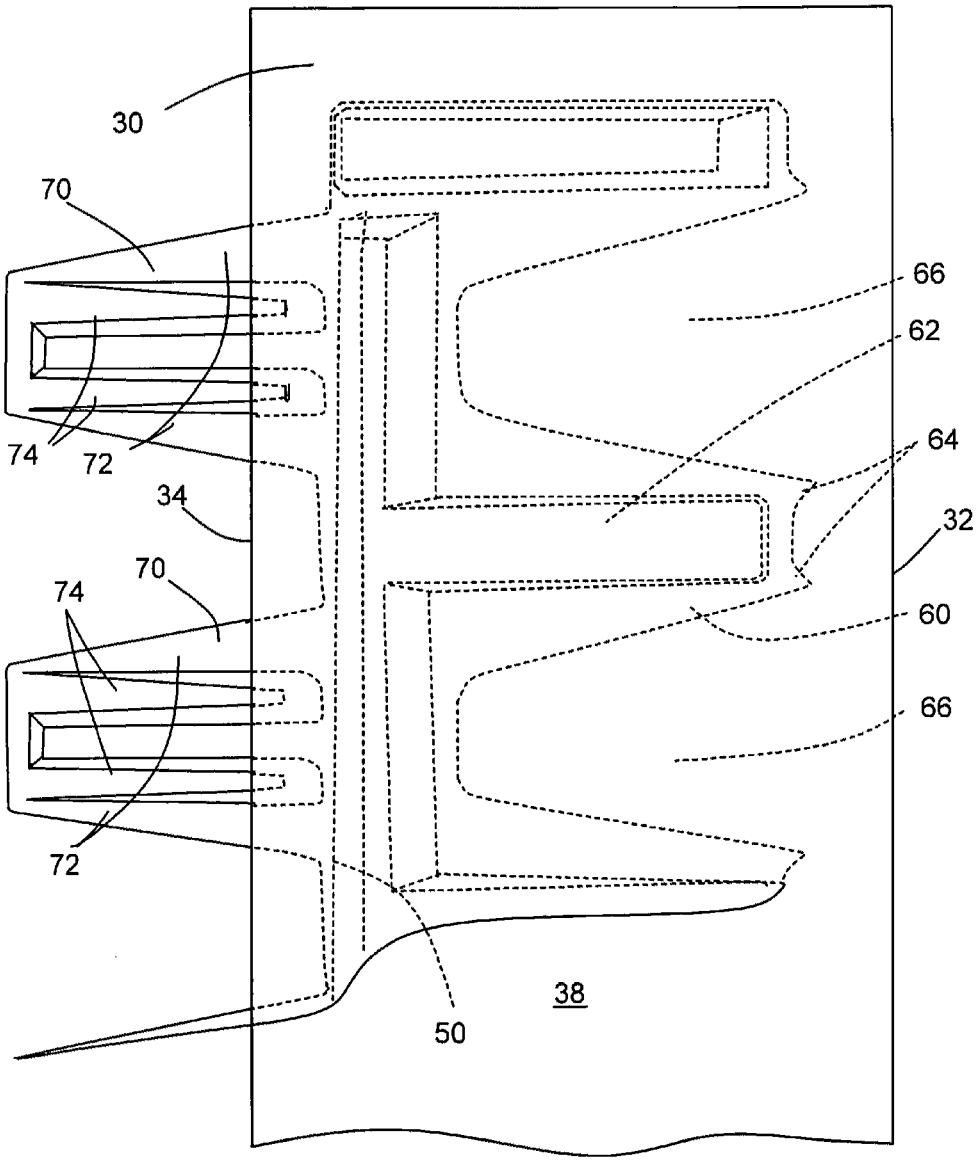
FIG. 3 is a top view of the rain gutter filter shown in FIG. 1.
Figure 4:
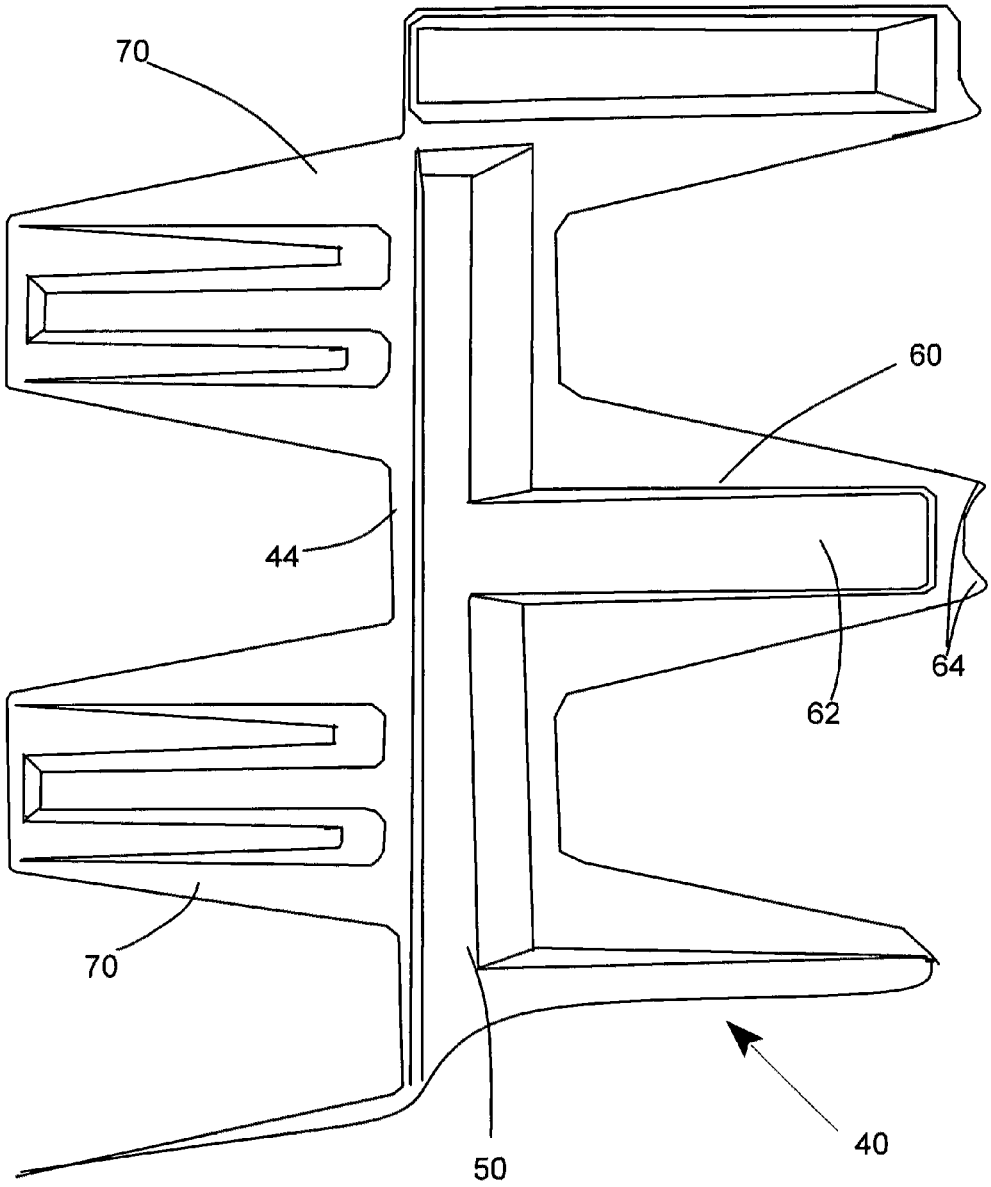
FIG. 4 is a top view of the support member shown in FIG. 2.
Figure 5:
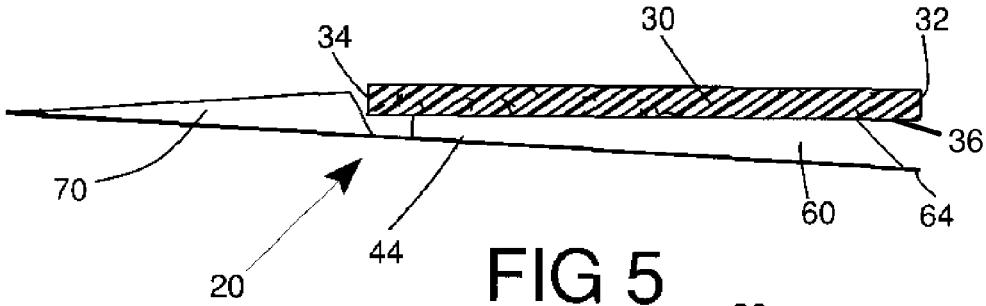
FIG. 5 is a side sectional view of the rain gutter filter of FIG. 1, again shown in a flat storage or shipping position.
Figure 6:
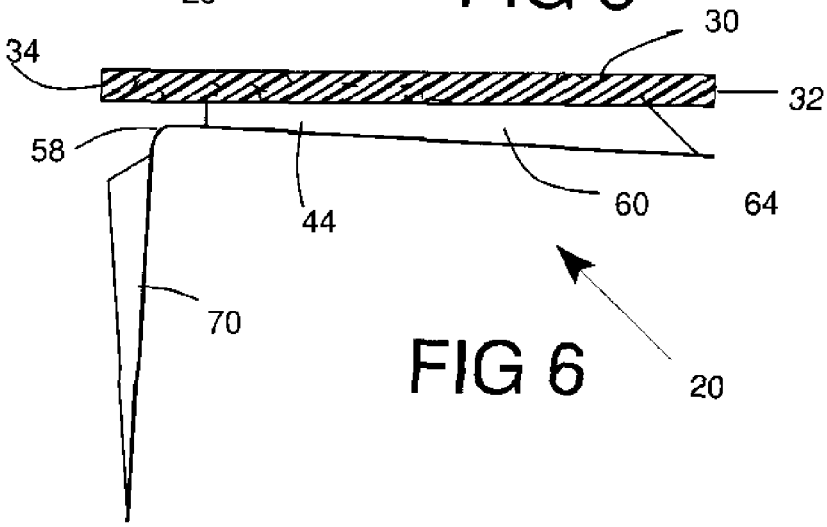
FIG. 6 is a side sectional view of the rain gutter similar to that shown in FIG. 5, in which support legs have been bent about a hinge section into an operative position in which the rain gutter would be supported in a standard rain gutter.

The rain gutter filter 20 of this invention includes a liquid permeable strip 30 affixed to a support member 40. The rain gutter filter 20 is suitable for use with a standard rain gutter 10 as shown in FIGS. 7-10. The rain gutter filter 20 can also be stored or shipped in a flat configuration, as shown in FIGS. 1-5, and the support member 40 is hinged for positioning the rain gutter filter in an operative position for insertion into a standard rain gutter 10 as shown in FIGS. 6-9. In the operative position, the liquid permeable strip 30 is supported along the top of the gutter 10 so that rain water can only enter the rain gutter 10 through the liquid permeable or porous strip 30. More importantly, solid debris, such as leaves, pine needles, twigs, litter or any other solid material that can be blown through the air or which would slide down an inclined roof cannot enter the rain gutter 10. The pores, interstices or openings in the liquid permeable strip are not large enough to permit passage of commonly encountered solid material that would clog the gutter. However, the pores can be large enough to permit passage of small particles that would not adversely affect a standard rain gutter. For example, the pores should preferably be large enough to permit the passage of "shingle grit", the tiny particles that become dislodged from roofing shingles. In the preferred embodiment of this invention, the liquid permeable strip 30 could have a thickness of from 0.38 to 0.50 inch between the underside 36 and the top side 38, although the thickness can vary outside this range and still be effective. For instance, a thickness of 0.25 inch could be employed, at least in some situations. In the preferred embodiment, as seen in FIGS. 1, and 5-7, the liquid permeable strip has the shape of a rectangular solid extending between a front edge 32 and a rear edge 34.

Although any number of liquid permeable materials could be used to fabricate the strip 30, the preferred embodiment of this invention employs a reticulated polyurethane foam material. Reticulated polyurethane foam is sufficiently porous or liquid permeable to freely permit passage of rain water at rates that would be encountered in conditions that would not otherwise cause a standard rain gutter to overflow even in the absence of any gutter filtering or anti-clogging device. A reticulated polyurethane foam is generally formed from an open cell foam which is subjected to a post thermal treating process. Very thin cell membranes of the open cell foam are vaporized during this thermal treating process, leaving only foam strands or struts. This flexible foam structure, without cell membranes has a natural pentagonal dodecahedron geometric shape with twelve plane faces. A fully open pore structure results, and it is both air and liquid permeable. The size of the pores can be precisely controlled and will determine the degree of permeability. Standard reticulated polyurethane foam, like other foam materials, is not suitable for use in situations where it will be exposed to weather and where it would be subjected to ultraviolet light, such as in sunlight. The negative long term effects of ultra-violet radiation from the sun can break down foam plastic structures and cause product failure within six to eight months and to oxidize and disappear within twenty four months. The reticulated polyurethane foam employed in the liquid permeable strip 30 of this invention is treated with a binding agent and ultraviolet resistive and flame retardant compositions so that it would be suited for use in a filter 20 for gutters 10. Suitable representative binding agents include acrylic latex and phenolic latex. An acrylic latex, such as provided as a straight up coating under the name of Paranol AA-G-72 will extend product life cycle indefinitely during heating and cooling cycles and will help reduce flame spread and enhance ultraviolet resistance. The molecular bond formed in the acrylic is inherently resistant to ultraviolet radiation, and testing of this product to ASTM G53 criteria at 1000 hours has resulted in no visual degradation. Such compositions will add sufficient ultraviolet resistance and flame retardant characteristics without unduly limiting the porosity or liquid permeability. The foam can also be treated with a fire retardant substance containing or formed from antimony oxide that will prevent the spread of flames. In particular, another fire retardant derivative Decabromodiphenyl is a halogen and it burns, bromine molecules are released that push or force oxygen molecules away from the coating and thereby prevent oxygen from fueling a fire in a manner that has been employed for some time.

The pores or interstices of a reticulated polyurethane foam, treated in this manner, can be large enough to permit the passage of rain water, and even tiny particles, such as shingle grit, but can be small enough to prevent the passages of solid material that might clog an unprotected rain gutter, such as leaves, pine needles, twigs and litter. One alternative liquid permeable material that could be substituted for reticulated polyurethane foam would be a porous matt formed from randomly interlaced fibers or plastic strands, which can exhibit sufficient porosity for this application. Polyolefin foams could also be employed. It should be understood, that still other liquid permeable materials could be used in conjunction with the support member 40 to form the liquid permeable strip 30 according to this invention.

Figure 9:
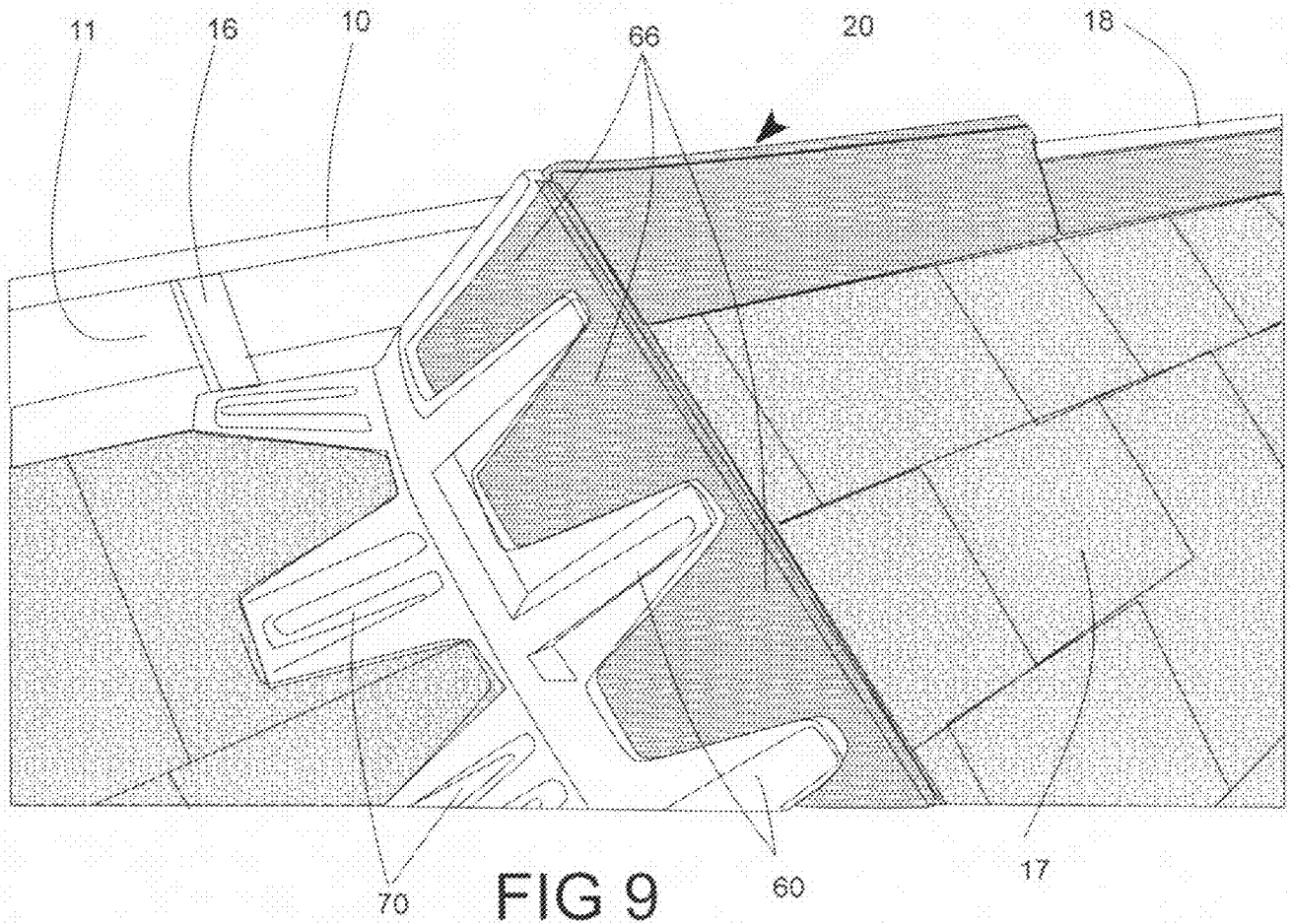
FIG. 9 is a view of showing the rain gutter filter of this invention during insertion into a rain gutter during an actual installation.

In the preferred embodiment of this invention, the support member 40 comprises a thermoformed or vacuum formed member fabricated from a plastic material, such as a thermoplastic material, and more specifically it could be a polyolefin material. In the preferred embodiment polyethylene is employed and it can have a thickness of less than one inch-eight (⅛) inch and preferably between 0.010 to 0.060 inch. Although raised surfaces are formed on the support member 40, the thickness remains substantially constant between opposite ends 42. By forming the support member 40 is this manner, the support member 40 will not only be cost effective to produce, but it will also limit the space that would be occupied in the channel 11 of a gutter 10, so as not to unduly interfere with the flow of water. Support member 40 includes a base 44 including a protruding central rib 50 and a series of spaced apart arms 60 that extend from a front side 52 of the central rib 50. The raised or protruding central rib 50 will provide strength to the support member 40 as well as providing a surface for affixing the liquid permeable strip 30 to the support member 40. While the protruding central rib 50 does help keep the shape of the filter 20, it will still be flexible enough to bend the support member 40 during insertion of the filter 20 onto the gutter 10 as shown in FIG. 9.

The arms 60 on the supporting base 44 are spaced apart by gaps 66. Each arm includes raised or embossed surfaces or ridges 62 which are formed during the thermoforming or vacuuming forming process. These raised arm surfaces or ridges 62 provide some stiffness, but the also provide a surface that can be affixed to the underside 36 of the liquid permeable strip 30. In the preferred embodiment an adhesive is used to join the arm ridges 62 and the upper surface of the central rib 50 to the underside 36 of the liquid permeable strip 30. The arms 60 also include anchoring tabs 64 extending from the ends of the arms 60. These arms tabs 64 will engage the inside of the gutter 10 after insertion of the support member 40 into the top of the gutter channel 11 to act as one means preventing dislodgment of the filter 20 from the gutter 10. However, these tabs 64 are sufficiently flexible to bend when the support member 40 is inserted into the gutter 10.

The gaps 66 between adjacent arms provide ample space for water to flow through the liquid permeable strip 30 relatively unimpeded. The flow rate through the foam or porous strip 30 will be as great as for other gutter protective devices, and should be sufficient for all circumstances that are to be expected.

Legs 70 extend from the opposite or rear side 54 of the protruding central rib. Legs 70 have raised surfaces 72 to provide stiffness, and the legs 70 have sufficient strength to engage the bottom gutter surface 12 and hold the liquid permeable strip 30 in place to filter the top opening 13 of gutter 10. In the preferred embodiment, the legs 70 are laterally offset from the arms 60. The offset relationship of the legs 70 relative to arms 60 is not necessary for operation of the filter 20. However, by offsetting the arms 60 and the legs 70, the support member can be more economically manufactured by saving raw material. The legs 70 would be formed from the material that would occupy the gaps 66 between adjacent arms 60. A flat sheet of deformable plastic material would be shaped by the thermoforming process with the legs 70 being formed out of the material that would be cut from the material forming an adjacent support member.

The support member 40 is formed from a material that is thin enough to allow the legs 70 to be hinged, folded or bent relative to the base 44 formed by the central protruding rib 50 and the arms 60. The hinge line 58 will be parallel to the central rib 50 and will be located adjacent to the rear side 54 of the central rib 50. The legs 70 can be hinged until they are substantially perpendicular to the arms 60 and to the liquid permeable strip 30. In this operative position the legs 70 can be inserted into the gutter 10 through the top gutter opening 13. The legs can be bent individually as the legs are sequentially inserted into the gutter. Since the filter 20 can be mounted on the gutter 10 by bending the legs 70 and inserting the legs 70 from above, no tools are needed to install the filter 20 and the arms 60 can be fitted beneath the front edge 18 of the gutter 10 to secure the filter 20 on the gutter 10. The anchoring tabs 64 on the ends of the arms 60 are easy to insert, but will provide extra grip once they are inserted into the gutter slot 15 and the front gutter edge 18 forming the top of gutter slot 15.

The filter 20 can be assembled by applying an adhesive to the central rib 50 and to the raised surfaces or ridges 62 on the arms 60. A liquid permeable strip 30 can then be affixed to the support member 40 by the adhesive. A reticulated foam strip 30 can be affixed to the plastic support member 40 in this manner. The preferred method of assembling a reticulated foam strip 30 is to first nest end portions of two support members, with an end arm 40 of one overlapping an end arm of a second support member, and then affixing two support members 40 to a single and longer reticulated foam strip 30. This facilitates economical manufacture of the two main component parts. For example, a forty-eight (48) inch long reticulated foam member 30 can be affixed to two partially overlapping twenty-four and one quarter (24.25) inch support members 40 to form a single forty-eight (48) inch long filter 20. In the preferred embodiment, the foam member 30 would be five and one-quarter (5.25) inches wide and can be fabricated by cutting sheets of forty-eight (48) inch long sheets of reticulated foam. A thermoformed support member 40 is more conveniently fabricated in smaller sections. Other fabrication techniques can also be employed. In its manufactured configuration, the support member remains generally flat with the legs 70 generally extending in the same plane as the arms 60. Because of this flat configuration, multiple filters 20 can be stacked in overlapping relationship to reduce the space needed for storage and shipment.

Figure 7:
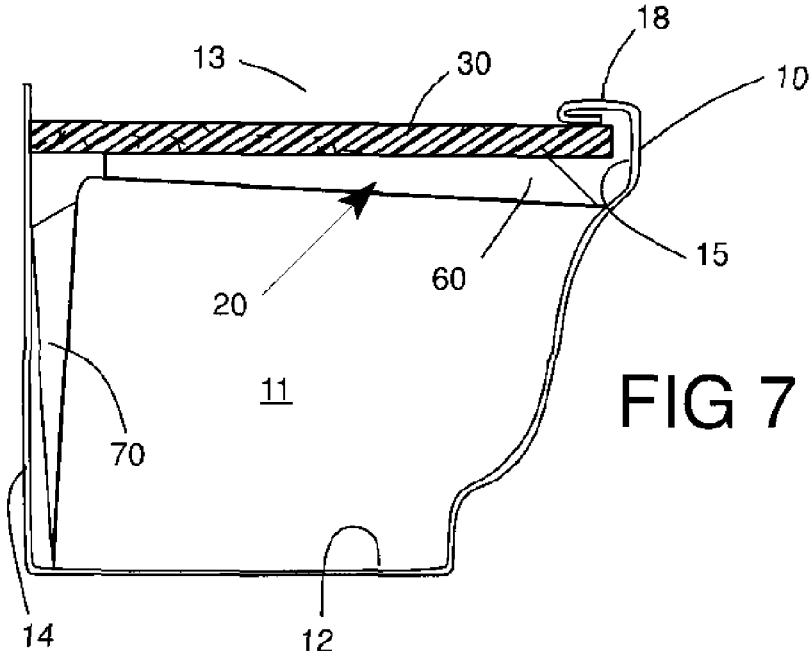
FIG. 7 is a side sectional view similar to FIGS. 5 and 6 shown the rain gutter filter positioned within a rain gutter.
Figure 8:
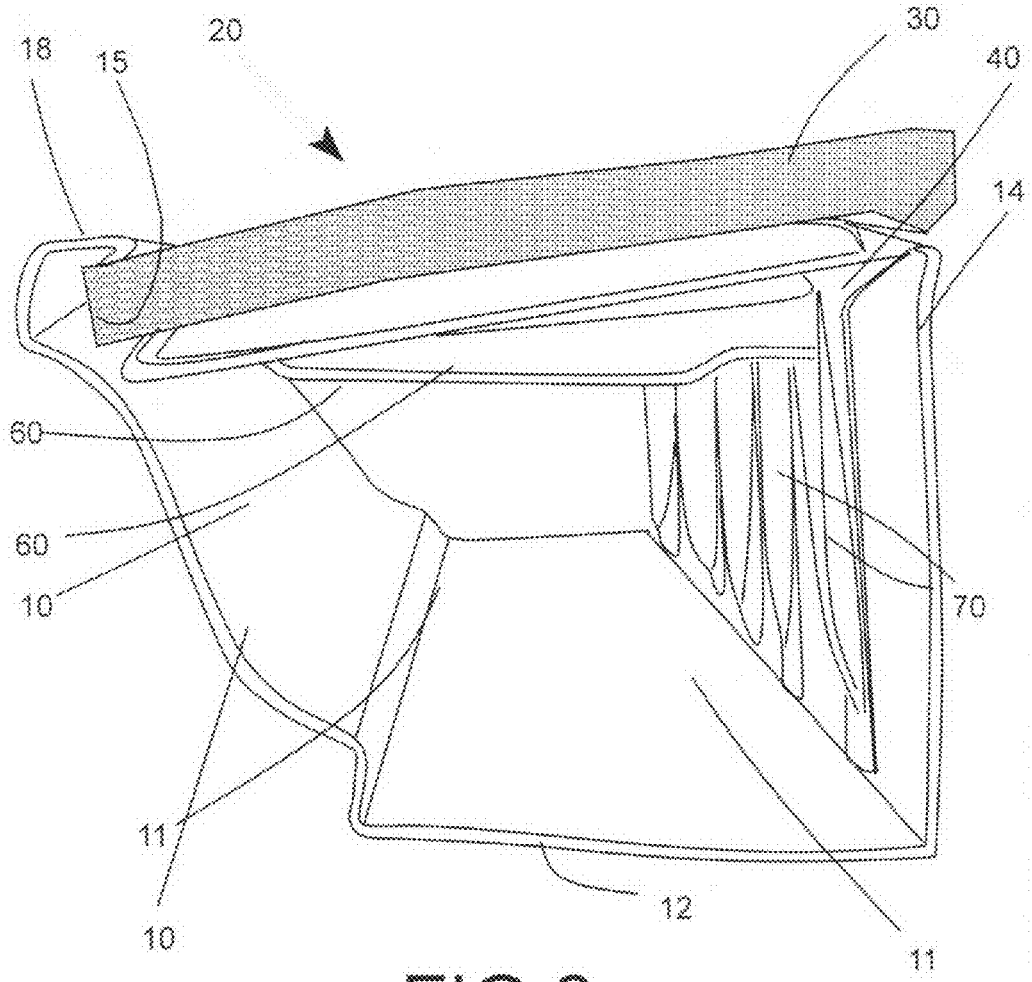
FIG. 8 is a view similar to FIG. 7, showing an actual installation.
Figure 10:
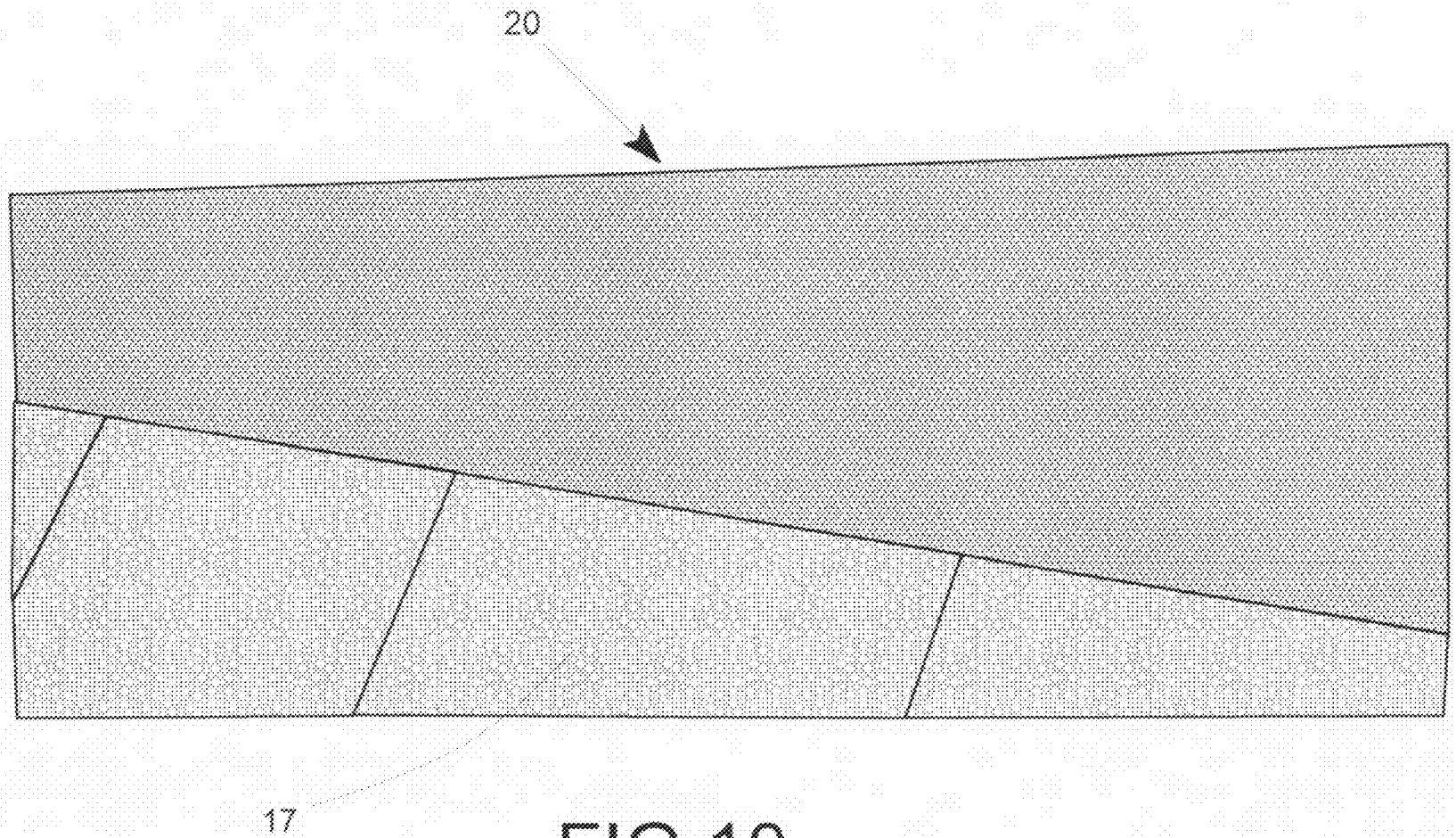
FIG. 10 shows the top of the rain gutter filter of this invention after it has been actually installed over the gutter and the manner in which it can extend outward from the roof of the building on which the rain gutter is mounted.

The filters 20 can be delivered to a job site in the flat configuration. The first step in installing the filters 20 to a rain gutter 10 is to fold the legs 70 relative to the foam strip 30 and to the arms 60. In this configuration the legs 70 can be inserted into the gutter channel 11 from above, with the legs 70 being inserted along the inside surface of the vertical gutter wall 14, which will be adjacent the roof 17 on which the gutter is mounted. As best seen in FIG. 8, the legs 70 will be essentially flush with the rear gutter wall 14 and there will only be minimal reduction in the cross section area of the gutter channel 11, so flow will not be obstructed. Adjacent legs are spaced apart so that the filter 20 can be inserted over conventional gutter hangers 16. Both thermoformed support members 40 and reticulated foam strips 20 can be easily cut to length by scissors, shears or a construction knife, in the event that the hangers 16 happen to be in a position where a leg 70 might otherwise hit the hanger 16. Of course the filters 20 can be cut to length to fit the specific installation. The filters 20 can also be cut at an angle to fit bends in the rain gutter 10. FIG. 9 shows that both the reticulated foam strip 30 and the support members 40 are easily bent and flexed so that they can be easily inserted into the gutter without damaging the gutter roofing. The filters 20 can be fitted beneath roofing shingles that might overlap the gutter 10. A preferable installation would have the front edge of the foam strip 30 inserted into the inwardly facing slot 15 at the front of a standard K-Type rain gutter 10. Such a condition is shown in FIGS. 7 and 8. FIG. 10 shows that one section of the foam strip 30 has been inserted beneath the top edge 18 at the front of the gutter for a portion of the length of the rain gutter. A second foam section, positioned in abutting relationship with the other section has the front edge of the foam 30 laying over the top front edge 18 of the gutter 10. This configuration is also functional, because the arms 60, and especially the anchoring tabs 64 are in the gutter slot 15 and beneath the front top edge 18 to hold the front of the foam strip 30 in place. In either configuration the filter 20 can slope so that the front edge is lower than the rear edge adjacent the roof line, as shown in FIG. 8.

Figure 11:
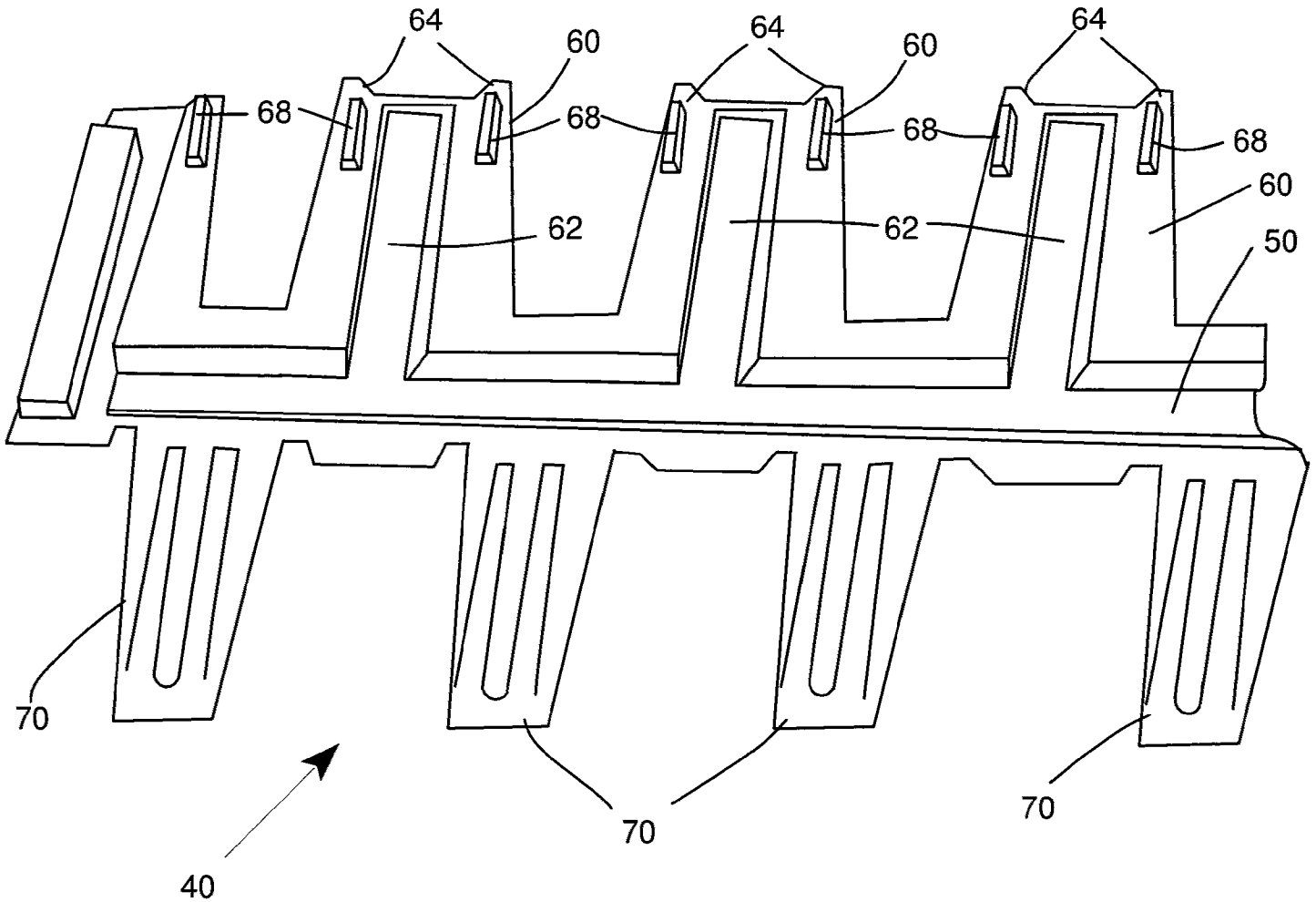
FIG. 11 is a view of the bottom of a modified version of the support member showing elevation forms adjacent anchoring tabs on the ends of the arms.

FIG. 11 shows another version of the support member 40 in which the arms 60 differ slightly from the arms 60 shown in FIGS. 1-4. The anchoring tabs 64 extend further than those shown in FIGS. 1-4. An elevated form or rib 68 is formed on the arm 60, just beneath the corresponding anchoring tab 64. These elevated rib 68 will strengthen the corresponding anchoring tabs 64 so that they will form a better grip with the inside of the gutter 10 or in the gutter slot 15. These elevated ribs 68 will extend from the bottom surface of the arms 60, so that they will not interfere with the foam or other material comprising the liquid permeable layer or strip 30, which is secured to the top sides of the arms 60 along the arm stiffening ribs 62, normally by a suitable adhesive. The undersides of the arm stiffening ribs 62 are shown in FIG. 11, so that the ribs 62 are actually recessed in this view.

We claim:

1. A device to prevent clogging of a rain gutter by leaves, twigs and solid debris, the device comprising:

a liquid permeable foam strip having a width sufficient to span a rain gutter and having a length greater than the width, and a thickness sufficient to prevent passage of leaves, twigs and solid debris therethrough;

a support member having a thickness less than the thickness of the porous foam strip, the support member supporting the liquid permeable foam strip above a bottom surface of the rain gutter when the device is positioned in a rain gutter, the support member further comprising;

a series of spaced apart arms affixed to an undersurface of the liquid permeable foam strip leaving a portion of the undersurface of the liquid permeable foam strip exposed to allow rain to pass through the liquid permeable foam strip and into the rain gutter; and legs extending from the spaced apart arms so that the legs can extend transverse to the spaced apart arms and to the liquid permeable foam strip to support the liquid permeable foam strip above the bottom surface of the rain gutter.

2. The device of claim 1 wherein the support member comprises a continuous member extending along the undersurface of the liquid permeable foam strip to provide support at opposite ends of the liquid permeable foam strip.

3. The device of claim 2 wherein the spaced apart arms and the legs extend from opposite sides of a central rib.

4. The device of claim 1 wherein the legs extend generally parallel to an edge of the liquid permeable foam strip so that the legs will extend generally parallel to a vertical side of the rain gutter when positioned in the rain gutter so as not to obstruct passage of liquid in the rain gutter.

5. The device of claim 1 wherein the support member comprises a thermoformed panel.

6. The device of claim 1 wherein the legs are hingable relative to the arms.

7. The device of claim 1 wherein the liquid permeable foam strip has a thickness less than an inwardly facing gutter slot on the rain gutter so that the liquid permeable foam strip can be inserted into the inwardly facing gutter slot along the length of the rain gutter.

8. A device to prevent a rain gutter from being clogged by solid debris, wherein the device comprises:

a liquid permeable foam member;

a thermoformed support member affixed to the liquid permeable foam member, the thermoformed support member being formed of a formable sheet material and further comprising;

a protruding rib extending between opposite ends of the thermoformed support member;

a series of spaced apart arms extending from one side of the protruding rib, the arms including a protruding ridge, the protruding ridge on the arms and the protruding rib being affixed to an undersurface of a liquid permeable foam member with gaps between spaced apart arms permitting flow of rain water through the liquid permeable foam member and into the gutter; and a series of spaced apart legs extending from a second side of the protruding rib, transverse to the liquid permeable foam member to extend between the liquid permeable foam member and a bottom surface of a rain gutter in which the device is positioned.

9. The device of claim 8 wherein legs are hingable relative to the protruding rib so that the device can be stored and shipped in a relatively flat configuration.

10. The device of claim 8 wherein anchoring tabs extend from distal ends of the arms, and the anchoring tabs include elevated ribs adjacent to the anchoring tabs to strengthen the anchoring tabs.

* * * * *